US008235125B2

(12) United States Patent
Borak, Jr.

(10) Patent No.: US 8,235,125 B2
(45) Date of Patent: Aug. 7, 2012

(54) SYSTEM AND METHOD FOR TERMINATING TUBING

(75) Inventor: Eugene A. Borak, Jr., Tomball, TX (US)

(73) Assignee: Vetco Gray Inc., Houston, TX (US)

( * ) Notice: Subject to any disclaimer, the term of this patent is extended or adjusted under 35 U.S.C. 154(b) by 774 days.

(21) Appl. No.: 12/348,328

(22) Filed: Jan. 5, 2009

(65) Prior Publication Data

US 2010/0170679 A1 Jul. 8, 2010

(51) Int. Cl.
*E21B 19/00* (2006.01)

(52) U.S. Cl. ..... 166/379; 166/75.13; 166/88.4; 166/85.3

(58) Field of Classification Search ..... 166/379, 166/85.3, 85.4, 86.1, 75.13
See application file for complete search history.

(56) References Cited

U.S. PATENT DOCUMENTS

2010/0206545 A1* 8/2010 Nguyen ..... 166/88.4

OTHER PUBLICATIONS http://www.thefreedictionary.com/thread.*

* cited by examiner

*Primary Examiner* — Kenneth L Thompson
*Assistant Examiner* — Yong-Suk Ro
(74) *Attorney, Agent, or Firm* — Bracewell & Giuliani LLP

(57) ABSTRACT

A technique is provided for terminating tubing. In the technique, a tubing termination assembly is used to terminate control line tubing from a downhole safety valve at a wellhead component. The tubing termination assembly utilizes a seal ring to form a seal around control line tubing extending from a port through a wellhead component. A seating surface is provided in the seal ring, rather than in the wellhead component, to which a seal member is abutted to form the seal with the control line tubing. The seal ring also comprises a threaded portion to enable a threaded member to urge the seal member against the seating surface.

8 Claims, 5 Drawing Sheets

SYSTEM AND METHOD FOR TERMINATING TUBING

BACKGROUND

The invention relates generally to a system and method of terminating tubing that extends through a member. In particular, the invention relates to a system and method for terminating tubing that extends through a wellhead component.

A downhole safety valve is a safety feature used in oil and gas wells. As its name implies, a downhole safety valve is located in a well at a point below the surface of the ground. The purpose of a downhole safety valve is to prevent an uncontrollable release of fluids from an underground reservoir in the event of damage to the surface components of a well. For example, the surface components of a well may be destroyed or damaged by the wind and waves produced by a hurricane. In such a scenario, the reservoir fluids could flow to the surface and be released into the environment if a downhole safety valve was not in service. Downhole safety valves commonly are unidirectional valves that are oriented in the well's production tubing such that a flow of wellbore fluids upward from an oil or gas reservoir causes the downhole safety valve to close, preventing the wellbore fluids from reaching the surface.

Typically, hydraulic pressure applied through tubing, referred to as a control line, is used to control downhole safety valves. When sufficient hydraulic pressure is applied down the control line, the downhole safety valve is forced open. This enables wellbore fluid to flow up and out of the well through the production tubing. However, if the hydraulic pressure in the control line is lost, a spring within the downhole safety valve will close the downhole safety valve, thereby preventing wellbore fluid from flowing out of the well. Typically, the pressure used to operate the downhole safety valve is greater than the pressure of the wellbore fluids. For example, if the wellbore fluids were being produced at a pressure of 15,000 psi, the control line for the downhole safety valve may be set to provide a pressure of 17,000 psi to open the downhole safety valve.

The control line typically is directed upward from the downhole safety valve through the casing of the well. During the stage of well development when a blowout preventer (BOP) is installed over the well, the control line is routed through the BOP to a well control panel. Later, when the BOP is no longer necessary, the BOP is removed and the control line is re-routed through a port of another wellhead component. The control line is terminated at a termination connection that is threaded directly into the port of the wellhead component. A seating surface is machined into the wellhead component to enable a seal to be formed between the control line and the port to prevent wellbore fluids from leaking from the wellhead component via the annulus that surrounds the control line.

However, this method for terminating a control line in a wellhead component is problematic. Wellhead components may be quite large and bulky, thereby making machining operations on them difficult and time consuming. Forming a seating surface, such as a conical section, on a surface of a wellhead component may be particularly difficult and time consuming. In addition, when the seal is exposed to a high pressure, such as 15,000 psi, the port through the wellhead component may have to be very small relative to the diameter of the control line to enable the annulus of the control line to be sealed using a sealing member and the seating surface of the wellhead component. This adds an additional level of difficulty to the process of machining the port through the wellhead component. For example, in this type of operation, the diameter of the port may have to be as small as 5/16 of an inch for a 1/4 inch control line. Machining a 5/16 inch hole in a large, heavy, bulky object, such as a wellhead component, may be particularly difficult and time consuming.

Therefore, a more efficient technique is desired for terminating tubing extending through wellhead equipment. In particular, a technique is desired that would enable downhole tubing to be terminated at a wellhead component quickly and easily without difficult machining operations.

BRIEF DESCRIPTION

A technique is provided for terminating tubing. In one embodiment of the technique, a tubing termination assembly is used to terminate control line tubing from a downhole safety valve at a wellhead component. This embodiment of the tubing termination assembly utilizes a seal ring to form a seal around control line tubing extending from a port through a wellhead component. A seating surface is provided in the seal ring, rather than in the wellhead component, to which a seal member may be abutted to form a compression seal against the control line tubing. The seal ring also comprises a threaded portion to enable a threaded member to urge the seal member against the seating surface. In this embodiment, the seal ring also comprises a flexible sealing lip to form a seal against the wellhead component on a surface of the wellhead component around the port.

DRAWINGS

These and other features, aspects, and advantages of the present invention will become better understood when the following detailed description is read with reference to the accompanying drawings in which like characters represent like parts throughout the drawings, wherein.

Figure 3:
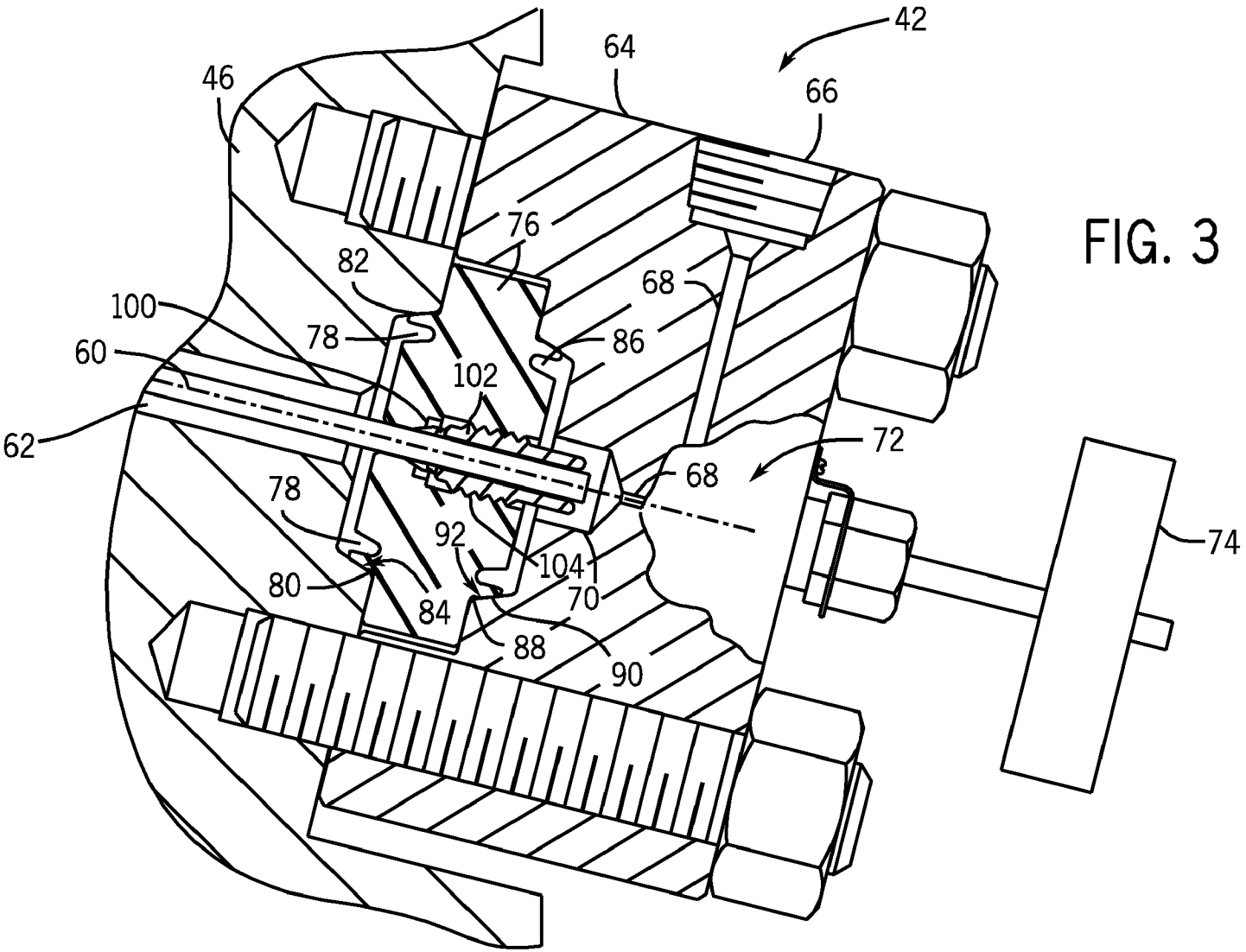
FIG. 3 is a detailed cross-sectional view of a control line termination block for the well completion assembly of FIG. 2, in accordance with an exemplary embodiment of the present technique.
Figure 5:
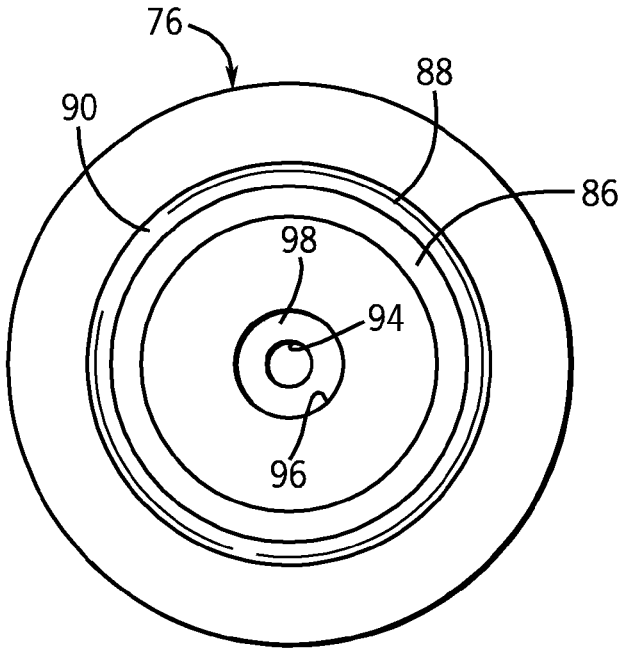
Figure 6:
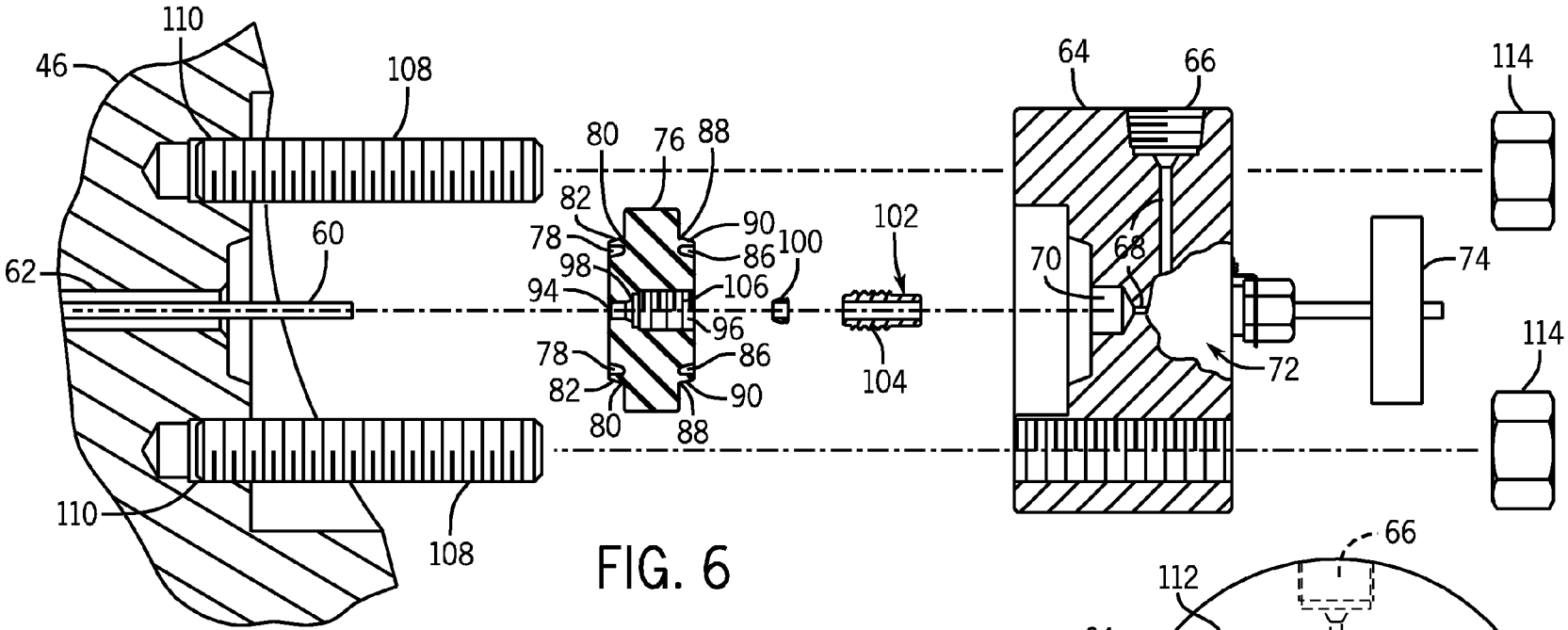
Figure 7:
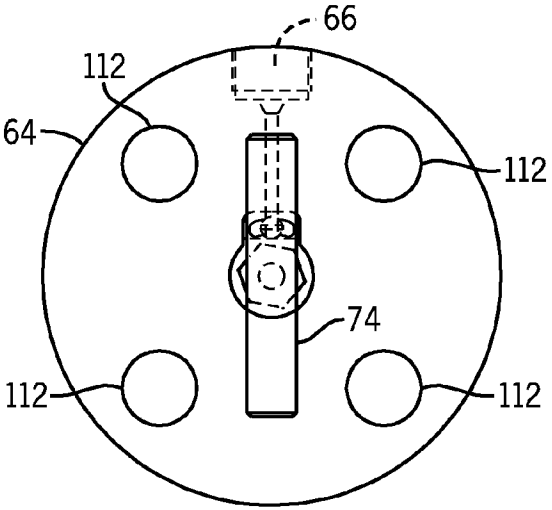

FIG. 5 is a top view of the seal ring of the tubing termination assembly, in accordance with an exemplary embodiment of the present technique FIG. 6 is an assembly view of the tubing termination assembly of FIG. 3, in accordance with an exemplary embodiment of the present technique; and FIG. 7 is a top view of the valve body of the tubing termination assembly, in accordance with an exemplary embodiment of the present technique.

DETAILED DESCRIPTION

Figure 1:
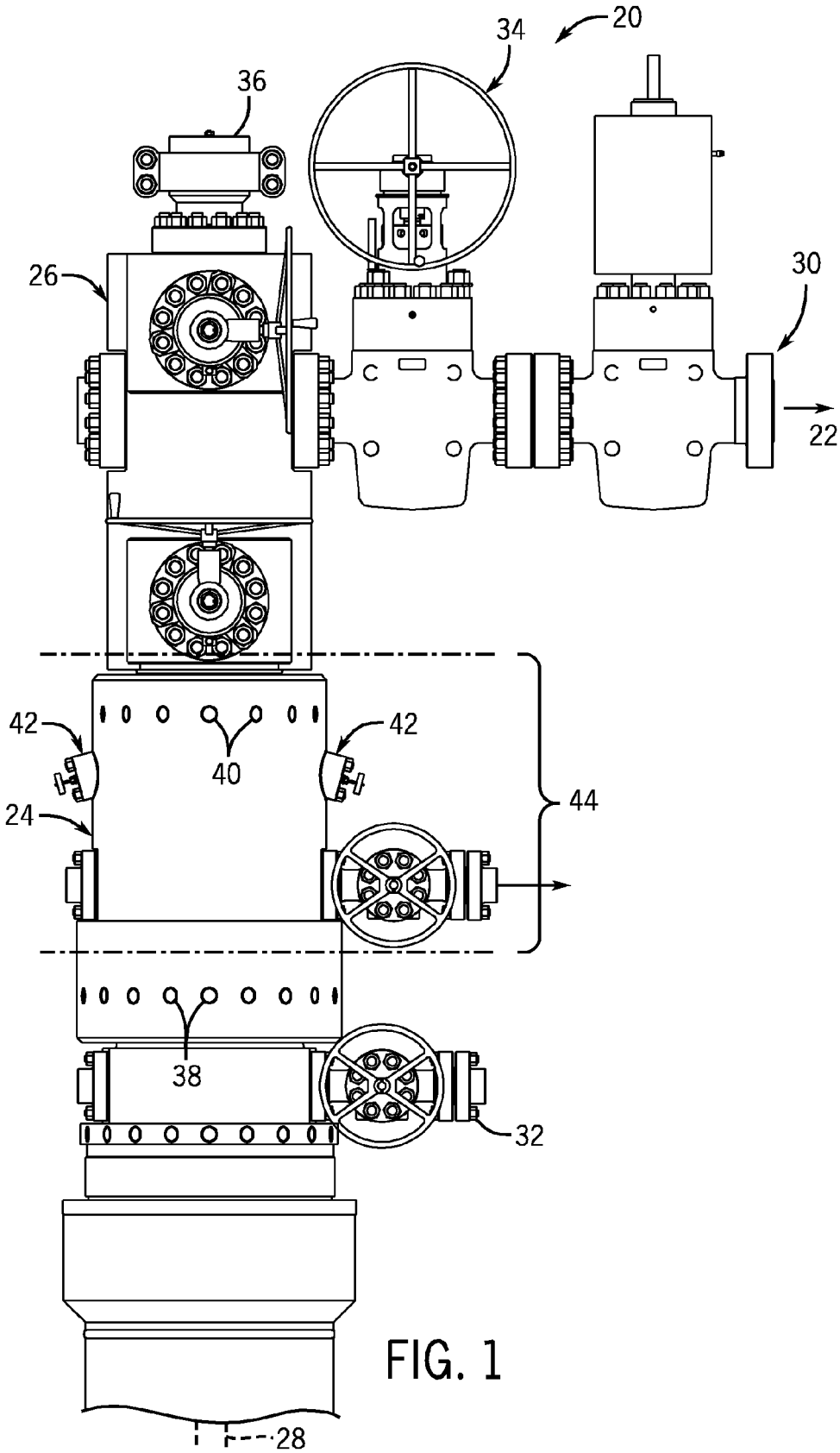
FIG. 1 is an elevation view of a well completion assembly, in accordance with an exemplary embodiment of the present technique.

Referring now to FIG. 1, the present invention will be described as it might be applied in conjunction with an exemplary technique, in this case a well completion assembly for directing oil and/or gas from a well to transmission pipelines or a storage facility, as represented generally by reference numeral 20. In this embodiment, the well completion assembly 20 is a standard tree. However, the technique may be used in trees other than a standard tree or any other type of device where a seal is desired to be formed around tubing extending through an object.

In the illustrated embodiment, the well completion assembly 20 comprises a tubing head assembly 24 and a block valve 26. The bottom of the tubing head assembly 24 may be connected to a spool (not shown). Wellbore fluid 22 is transported to the tubing head assembly 24 via production tubing 28. The production tubing 28 enters the bottom of the tubing head assembly 24. Wellbore fluid 22 exits the tubing head assembly 24 via a production line 30. In this embodiment, drain lines 32 are provided to enable fluids in one or more annuluses between production tubing 28 and one or more strings of casing to be drained.

As will be discussed in more detail below, the well completion assembly 20 has a vertical bore that extends through the tubing head assembly 24. The block valve 26 sits atop the tubing head assembly 24 to control access to the vertical bore of the tubing head assembly 24. The block valve 26 has hand wheels 34 that may be turned to open and close the block valve 26. In this embodiment, the block valve 26 comprises a lubricator adapter 36 to facilitate the installation of a lubricator on the well completion assembly 20. A lubricator is a specially fabricated length of casing or tubing that is connected temporarily to the lubricator adaptor 36 to enable wireline tools to be dropped into the wellbore through the block valve 26 and the tubing head assembly 24. The lubricator is adapted to maintain a seal around the wireline to maintain pressure within the wellbore.

The tubing head assembly 24 has a first series of fasteners 38 located circumferentially around the tubing head assembly 24 to activate a pack-off within the tubing head assembly 24. The tubing head assembly 24 has a second set of fasteners 40 located circumferentially around the tubing head assembly 24 to enable the block valve 25 to be secured to the tubing head assembly 24.

A control line extends upward from within the wellbore into the tubing head assembly 24. The control line is tubing that is terminated at a tubing termination assembly 42 on the outside of the tubing head assembly 24. The tubing termination assembly 42 is adapted to enable a hydraulic line from a well control panel to be connected to the tubing termination assembly 42. In addition, hydraulic pressure from the hydraulic line is coupled to the control line via the tubing termination assembly 42.

Figure 2:
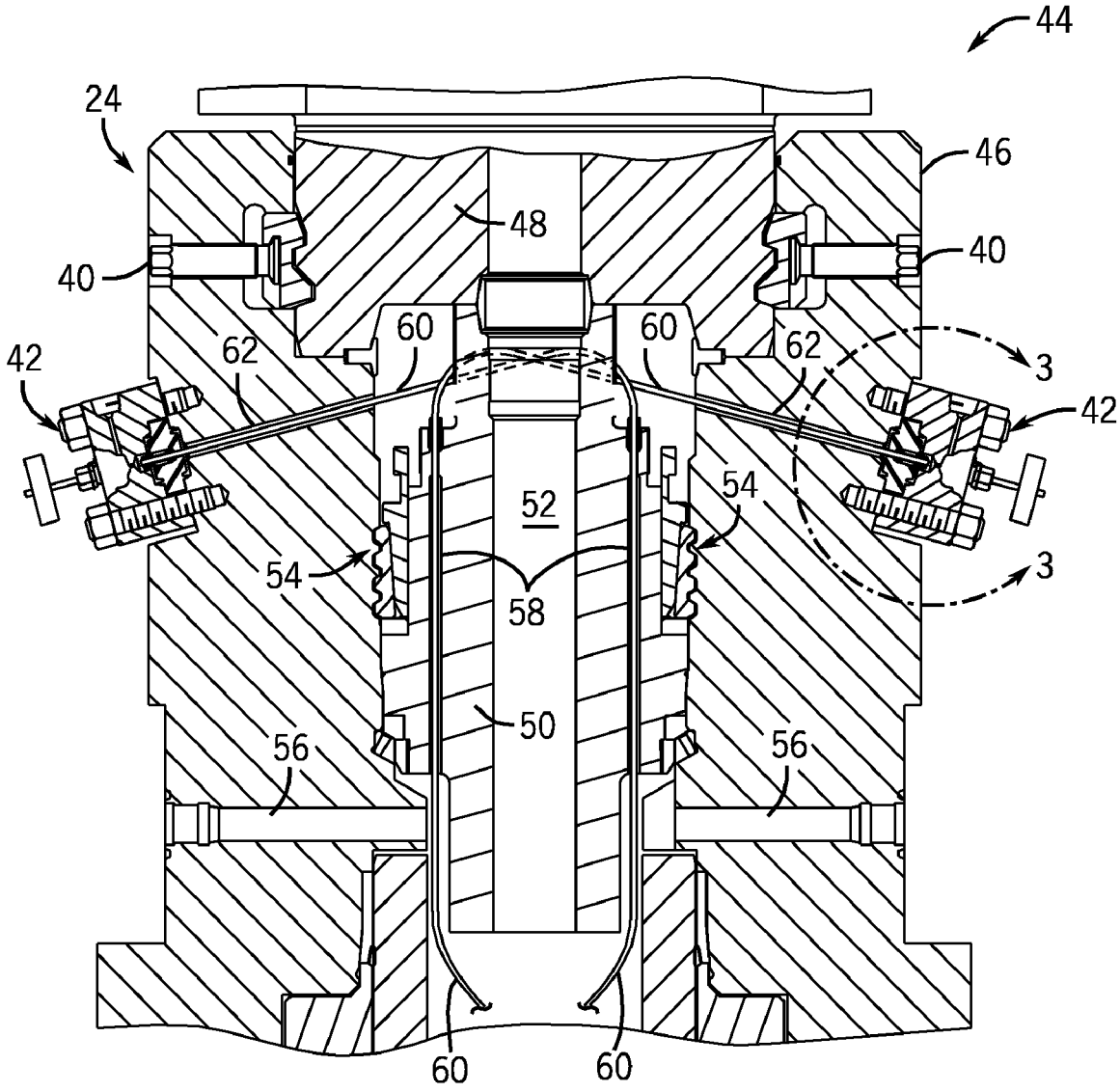
FIG. 2 is a cross-sectional view of a portion of the well completion assembly of FIG. 1, in accordance with an exemplary embodiment of the present technique.

Referring generally to FIGS. 1 and 2, a cross-sectional view of a portion of the well completion assembly 20 is presented, and represented generally by reference numeral 44. In this embodiment, the portion 44 of the well completion assembly 20 that is presented comprises the upper portion of a tubing head 46 and the lower portion of a block valve member 48. The production tubing 28 is supported by a tubing hanger 50 housed within an inner bore 52 of the tubing head 46. The tubing hanger 50, in turn, is secured to the tubing head 46 by a lockdown mechanism 54. Annulus ports 56 are provided to enable the annulus of the inner bore 52 around the production tubing 28 and below the tubing hanger 50 to be drained.

The tubing hanger 50 has control line ports 58 that extend vertically through the tubing hanger 50. In this embodiment, two control lines 60 extend up from downhole safety valves in the wellbore though the control line ports 58 in the tubing hanger. Seals (not shown) are disposed in the control line ports 58 in the tubing hanger 50 to seal the annulus formed in the control line ports 58 around the control lines 60. The control lines 60 are then routed though control line ports 62 in the tubing head 46. The control lines 60 extend from the control line ports 62 in the tubing head 46 and are terminated in the control line termination assemblies 42. However, the control line 60 may be routed through a wellhead component other than the tubing hanger 50. In addition, the tubing termination assembly 42 seals the annulus surrounding the control line 60 to prevent wellbore fluids from leaking from the tubing head 46 via the annulus formed in the control line port 62 around the control line 60. In other embodiments of the present technique, the tubing termination assembly 42 may be adapted to terminate tubing used for other purposes, such as chemical injection and tubing used to house electrical wiring or fiber optics used for instrumentation and/or control.

Referring generally to FIG. 3, the tubing termination assembly 42 has a valve body 64 with an access port 66 to enable a hydraulic line, such as from a well control panel, to connect to the tubing termination assembly 42. However, as noted above, the tubing termination assembly may be used with applications other than hydraulic tubing. In this embodiment, the access port 66 is threaded to facilitate connection with the hydraulic line. A passageway 68 extends through the valve body 64 to a control line receiving chamber 70. The control line receiving chamber 70 receives the end of the control line 60 and places the control line 60 in communication with the access port 66 and, thereby, a hydraulic line from the well control panel. In this embodiment, a valve 72 is disposed within the passageway 68 to control the flow of hydraulic fluid between the access port 66 and the control line 60. A hand wheel 74 is provided to open and close the valve 72.

Figure 4:
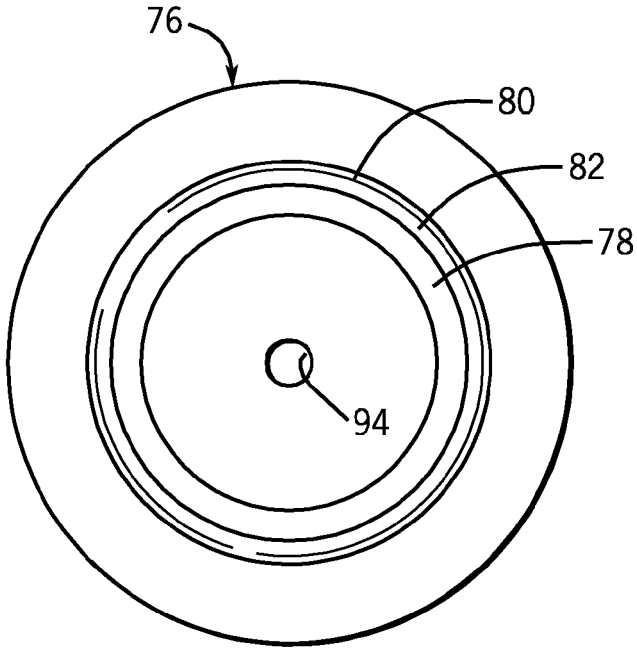
FIG. 4 is a bottom view of the seal ring of the tubing termination assembly, in accordance with an exemplary embodiment of the present technique.

Referring generally to FIGS. 3, 4, and 5, the tubing termination assembly 42 has a seal ring 76 that is adapted to provide the seating surface for establishing a seal around the control line 60, rather than having the seating surface in the tubing head 46. By moving the seating surface for establishing a seal around the control line 60 from the tubing head 46 to the seal ring 76, the need to machine a seating surface on the tubing head 46 is removed. In addition, the need to thread the control line port 58 also is removed because the seal for the control line 60 is not formed by a seating surface formed in the control line port 62.

In the illustrated embodiment, the seal ring 76 is comprised of metal. The seal ring 76 has a first cutout 78 on the side of the seal ring 76 that is to be disposed against the tubing head assembly 24. The first cutout 78 produces a first flexible sealing lip 80 in the seal ring 76. In this embodiment, the first flexible sealing lip 80 has been adapted with a sealing surface 82 to enable the seal ring 76 to form a better seal against a corresponding surface 84 on the tubing head 46. When the seal ring 76 is urged against the tubing head 46, the first flexible sealing lip 80 is driven against the tubing head 46. This causes the first flexible sealing lip 80 to flex and seats the seating surface of the first flexible sealing lip 80 against the corresponding surface 84 on the tubing head 46.

In the illustrated embodiment of the seal ring 76, the seal ring 76 is adapted to form a seal against a second object on the opposite side of the seal ring 76 as the first flexible lip 80. In this embodiment of the tubing termination assembly 42, the second object is the valve body 64. The seal ring 76 has a second cutout 86 disposed on a second side of the seal ring 76 that is oriented opposite of the valve body 64. The second cutout 86 produces a second flexible sealing lip 88 in the seal ring 76. The second flexible sealing lip 88 is adapted with a sealing surface 90 to enable the seal ring 76 to form a better seal against a corresponding surface 92 on the valve body 64 in this embodiment.

The seal ring 76 has a passageway through the seal ring 76 into which the control line 60 is inserted. In this embodiment, the control line 60 has been cut so that it will pass through the passageway and extend a short distance from the seal ring 76. The passageway has a first portion 94 with a first diameter and a second portion 96 with a second diameter. A seating surface 98 is located in the passageway between the first portion 94 and the second portion 96 of the passageway. In this embodiment, the seating surface 98 is a conical section. In addition, in the illustrated embodiment, a ferrule 100 and ferrule gland 102 are used to form a seal between the control line 60 and seal ring 76. The ferrule gland 102 has a male threaded portion 104 that corresponds to a female threaded portion 106 of the seal ring 76. As the ferrule gland 102 is threaded into the seal ring 76, the ferrule gland 102 urges the ferrule 100 against the seating surface 98. As the ferrule 100 is urged against the seating surface 98, the seating surface 98 compresses the ferrule 100 against the control line 60, forming a seal around the control line 60, thereby preventing wellbore fluids from leaking from the tubing head 46 via the annulus of the control line port 58. However, devices other than the ferrule 100 and ferrule gland 102 may be used to form a seal with the seal ring 76 around the control line 60.

Referring generally to FIGS. 6 and 7, a process of terminating tubing with the tubing termination assembly 42 to the tubing head 46 is presented. As part of the process, the control line 60 is fed into the seal ring 76. As noted above, the control line 60 is cut, in this embodiment, so that the control line 60 extends a short distance from the opposite side of the seal ring 76 when the seal ring 76 is disposed against the tubing head 46. The ferrule 100 is disposed over the control line 60 and disposed in the second portion 96 of the passageway of the seal ring 76. Similarly, the ferrule gland 102 is fed over the control line 60 and threaded into the seal ring 76. Eventually, the threading of the ferrule gland 102 into the seal ting 76 causes the ferrule gland 102 to urge the ferrule 100 against the seating surface 98 of the seal ring 76. As noted above, the urging of the ferrule 100 against the seating surface 98 of the seal ring 76 causes the ferrule 100 to be compressed against the control line 60, forming a seal around the control line 60. The urging of the seal ring 76 against the tubing head 46 causes the first flexible sealing lip 80 to flex and seals the sealing surface 82 of the first flexible sealing lip 80 of the seal ring 76 against a corresponding sealing surface 84 on the tubing head 46. The seal ring 76 thereby forms a seal around the control line port 62 of the tubing head 46.

The valve body 64 of the tubing termination assembly 42 is secured to the tubing head 46 by studs 108. In the illustrated embodiment, four studs 108 are used. The studs 108 have threaded portions 110 that are configured to thread into corresponding threaded holes in the tubing head 46, rather than into a threaded portion of the control line port 58. This provides a stronger method of securing the termination assembly 42 to the tubing head 46. Through-holes in the valve body 64 are aligned with the studs 108 extending from the tubing head 46. The valve body 64 is then urged toward the tubing head 46 so that the studs 108 extend through the through-holes 112 in the valve body 64. Nuts 114 may then be disposed on the ends of the studs 108 and tightened, urging the valve body 64 towards the tubing head 46 and the seal ring 76. Eventually, the tightening of the nuts 114 urges the valve body 64 against the seal ring 76 such that the sealing surface 90 of the second flexible sealing lip 88 of the seal ring is urged against the corresponding surface 92 of the valve body 64, forming a seal between the seal ring 76 and the valve body 64 around the second portion 96 of the passageway through the seal ring and the control line receiving chamber 70 of the valve body 64.

Once assembled, the control line 60 may be coupled to a well control panel, or similar device, via a hydraulic line connected to the access port 66. The hydraulic pressure in the hydraulic line is coupled to the control line 60 through the tubing termination assembly 42.

The termination assembly reduces manufacturing errors, and the cost thereof, by moving the threaded control line termination from a wellhead component and placing it on the seal ring 76, which is easily replaceable. The tubing termination assembly 42 also enables larger control line bores than used with current high pressure applications. For example, the tubing termination assembly 42 enables a seal to be formed around a control line 60 where the pressure in the control line port 58 is 15,000 psi and the port has a diameter of three-quarters of an inch or one inch, rather than five-sixteenths of an inch, in diameter. This is the result of having a plurality of fasteners used at locations about the control line port 58, rather than relying on a threaded connection within the control line port 58. Thus, a more secure mechanism can be used to secure the tubing termination assembly 42 to the tubing head 46. A three-quarter's of an inch or a one inch diameter control line port 58 is easier to machine in a tubing head 46 than a control line port 58 that is five-sixteenths of an inch in diameter. Thereby, reducing time and effort in manufacturing the tubing head 46.

In addition, a variety of different seal rings 76 may be manufactured to correspond to different diameter control lines 60. For example, a seal ring 76 intended for a larger diameter control line 60 may be manufactured with larger diameter passageways and seating surface. Similarly, a larger ferrule 100 and ferrule gland 102 may be used for larger diameter control lines. If there is a desire to replace an existing control line with a different diameter control line, the parts of the tubing termination assembly 42 can simply be replaced to correspond with the new diameter control line.

Furthermore, if a problem develops with a tubing termination assembly 42, the components of the tubing termination assembly 42 can be replaced quickly and easily in the field without having to machine the tubing head 46. For example, if there is a leak between the control line 60 and the seal ring 76, the seal ring 76, ferrule 100, and/or ferrule gland 102 can simply be replaced, if needed, to fix the leak. No repair of the tubing head 46 is required, such as machining a new seating surface in the tubing head 46.

In addition, the termination assembly 42 may be used to terminate tubing used for other purposes. For example, the termination assembly may be used to terminate tubing used to inject chemicals into the well from the surface at a wellhead component. In addition, the termination assembly may be used to seal tubing used to run electrical wiring or fiber-optic cable into a well at a wellhead component.

While only certain features of the invention have been illustrated and described herein, many modifications and changes will occur to those skilled in the art. It is, therefore, to be understood that the appended claims are intended to cover all such modifications and changes as fall within the true spirit of the invention. For example,

The invention claimed is:

1. A well completion system, comprising:

a well completion member having a port extending therethrough to enable a first tubing to pass from an inner bore of the well completion member to an external surface of the well completion member; and a tubing termination assembly, comprising:

a fastener adapted to secure the tubing termination assembly to the well completion member, and a seating surface adapted to cooperate with a sealing member to form a seal around the first tubing;

a seal ring having a seal ring port extending through the seal ring to enable the first tubing to extend through the seal ring; and wherein the seal ring port defines the seating surface.

2. The well completion system as recited in claim 1, wherein the seal ring comprises a threaded portion disposed within the seal ring port.

3. The well completion system as recited in claim 2, wherein the tubing termination assembly comprises a threaded member adapted to thread into the threaded portion of the seal ring to urge the sealing member against the seating surface of the seal ring.

4. The well completion system as recited in claim 1, wherein the fastener comprises a plurality of fasteners oriented around the port extending through the well completion member.

5. The well completion system as recited in claim 4, wherein each of the plurality of fasteners comprises a threaded member adapted for threaded engagement with a corresponding threaded portion of the well completion member.

6. The well completion system as recited in claim 1, wherein the tubing termination assembly comprises a connector adapted to connect a second tubing to the tubing termination assembly and to place the second tubing in communication with the first tubing.

7. The well completion system as recited in claim 1, wherein the well completion member is a tubing head adapted to support a tubing hanger.

8. The well completion system as recited in claim 1, wherein the first tubing is a control line for a downhole safety valve.

* * * * *